US011121458B2

(12) United States Patent
Lee

(10) Patent No.: US 11,121,458 B2
(45) Date of Patent: Sep. 14, 2021

(54) ANTENNA STRUCTURE

(71) Applicant: Wistron NeWeb Corp., Hsinchu (TW)

(72) Inventor: Yun-Tsan Lee, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 87 days.

(21) Appl. No.: 16/562,682

(22) Filed: Sep. 6, 2019

(65) Prior Publication Data

US 2020/0091595 A1 Mar. 19, 2020

(30) Foreign Application Priority Data

Sep. 19, 2018 (TW) ..... 107132949

(51) Int. Cl.

| | |
|---|---|
| ***H01Q 1/22*** | (2006.01) |
| ***H01Q 1/36*** | (2006.01) |
| ***H01Q 1/52*** | (2006.01) |
| ***H01Q 1/48*** | (2006.01) |

(52) U.S. Cl.

CPC ..... *H01Q 1/36* (2013.01); *H01Q 1/22* (2013.01); *H01Q 1/48* (2013.01); *H01Q 1/52* (2013.01)

(58) Field of Classification Search

CPC .. H01Q 1/22; H01Q 1/36; H01Q 1/48; H01Q 1/52; H01Q 1/243; H01Q 5/33; H01Q 5/35; H01Q 5/321

See application file for complete search history.

(56) References Cited

U.S. PATENT DOCUMENTS

| | | | | |
|---|---|---|---|---|
| 10,454,156 | B1 * | 10/2019 | Yang | H01Q 5/335 |
| 2011/0128200 | A1 * | 6/2011 | Hossain | H01Q 9/14 343/745 |
| 2012/0007782 | A1 * | 1/2012 | Nishio | H01Q 5/371 343/700 MS |
| 2014/0197993 | A1 * | 7/2014 | Li | H01Q 1/48 343/700 MS |
| 2015/0295314 | A1 * | 10/2015 | Oh | H01Q 21/0006 343/866 |

FOREIGN PATENT DOCUMENTS

TW 201112497 A 4/2011

* cited by examiner

*Primary Examiner* — Tung X Le
(74) *Attorney, Agent, or Firm* — McClure, Qualey & Rodack, LLP

(57) ABSTRACT

An antenna structure includes a ground element, a feeding radiation element, a first radiation element, and a second radiation element. The feeding radiation element is coupled to a signal source. The first radiation element is coupled to the ground element. The first radiation element is adjacent to the feeding radiation element. The feeding radiation element is coupled through the second radiation element to the ground element. A first loop structure is formed by the feeding radiation element, the first radiation element, and the ground element. A second loop structure is formed by the feeding radiation element, the second radiation element, and the ground element. The second loop structure includes neither any branching portion nor any protruding portion.

19 Claims, 6 Drawing Sheets

ANTENNA STRUCTURE

CROSS REFERENCE TO RELATED APPLICATIONS

This application claims priority of Taiwan Patent Application No. 107132949 filed on Sep. 19, 2018, the entirety of which is incorporated by reference herein.

BACKGROUND OF THE INVENTION

Field of the Invention

The disclosure generally relates to an antenna structure, and more particularly, it relates to a small-sized, wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

An antenna is indispensable in a mobile device supporting wireless communication. However, since a mobile device often has limited interior space, there is not sufficient area to accommodate the required antenna element. Accordingly, it has become a critical challenge for antenna designers to design a novel antenna that is small in size and has wideband characteristics.

BRIEF SUMMARY OF THE INVENTION

In a preferred embodiment, the disclosure is directed to an antenna structure including a ground element, a feeding radiation element, a first radiation element, and a second radiation element. The feeding radiation element is coupled to a signal source. The first radiation element is coupled to the ground element. The first radiation element is adjacent to the feeding radiation element. The feeding radiation element is coupled through the second radiation element to the ground element. A first loop structure is formed by the feeding radiation element, the first radiation element, and the ground element. A second loop structure is formed by the feeding radiation element, the second radiation element, and the ground element. The second loop structure includes neither any branching portion nor any protruding portion.

In some embodiments, the feeding radiation element is positioned between the first radiation element and the second radiation element.

In some embodiments, the feeding radiation element substantially has a straight-line shape.

In some embodiments, the first radiation element substantially has an L-shape.

In some embodiments, the second radiation element substantially has an L-shape.

In some embodiments, a coupling gap is formed between the first radiation element and the feeding radiation element.

In some embodiments, the antenna structure further includes a first reactance element coupled between the feeding radiation element and the first radiation element.

In some embodiments, the first reactance element is a capacitor.

In some embodiments, the capacitance of the capacitor is from 0 pF to 5 pF.

In some embodiments, the antenna structure further includes a second reactance element embedded in the first radiation element.

In some embodiments, the second reactance element is an inductor.

In some embodiments, the inductance of the inductor is from 0 nH to 5 nH.

In some embodiments, the first loop structure is excited to generate a first frequency band, and the second loop structure is excited to generate a second frequency band which is higher than the first frequency band.

In some embodiments, the first frequency band is from 2400 MHz to 2500 MHz, and the second frequency band is from 5150 MHz to 5850 MHz.

In some embodiments, the length of the first loop structure is equal to 0.5 wavelength of the first frequency band, and the length of the second loop structure is equal to 0.5 wavelength of the second frequency band.

In some embodiments, the first radiation element has a first height on the ground element, and the second radiation element has a second height on the ground element. The first height is greater than the second height.

In some embodiments, the first radiation element has a first height on the ground element, and the second radiation element has a second height on the ground element. The first height is equal to the second height.

In some embodiments, a first hollow region is inside the first loop structure, and a second hollow region is inside the second loop structure. The width of the first hollow region is greater than the width of the second hollow region.

In some embodiments, a first hollow region is inside the first loop structure, and a second hollow region is inside the second loop structure. The width of the first hollow region is smaller than the width of the second hollow region.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
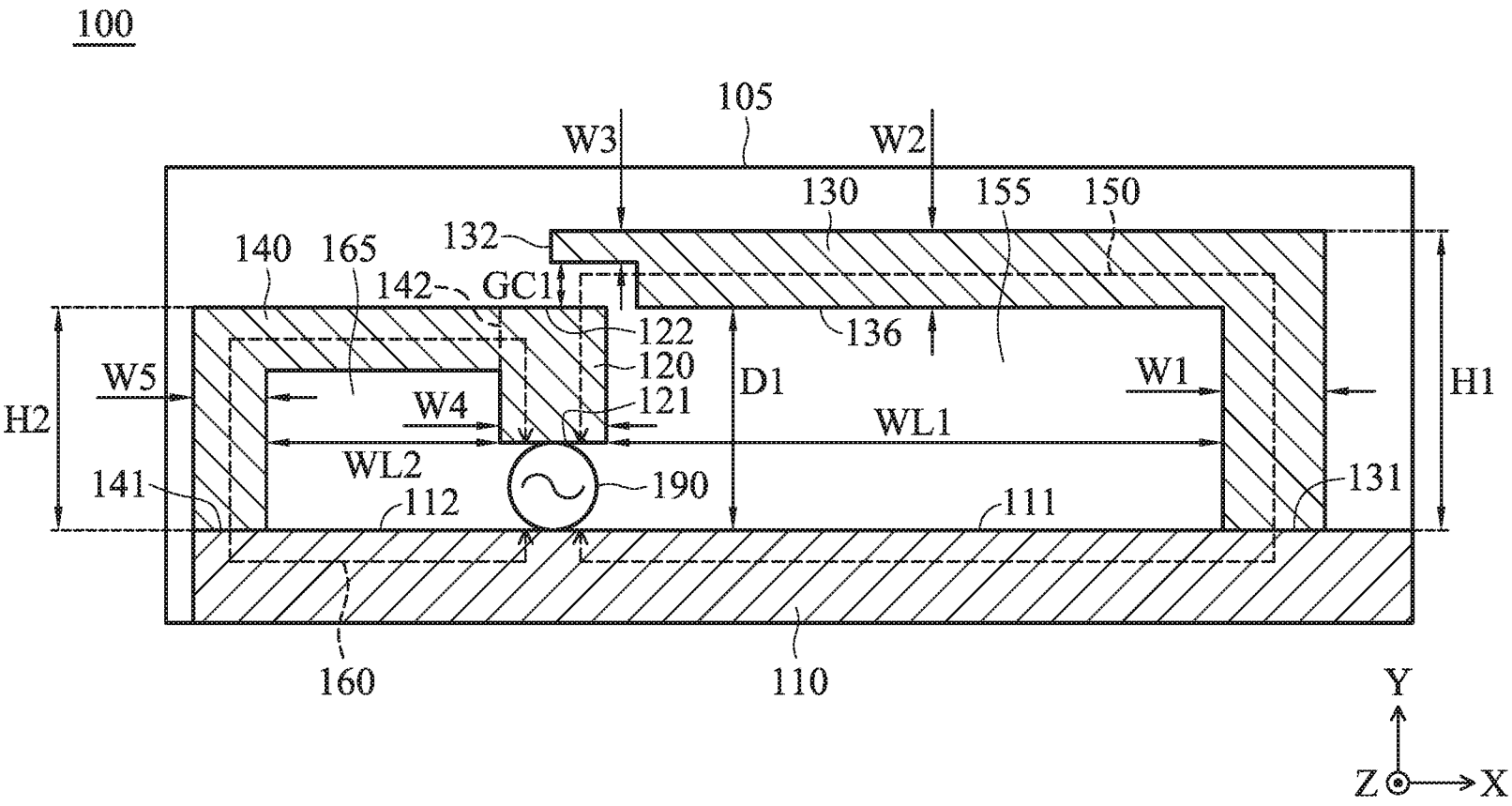
FIG. 1 is a diagram of an antenna structure according to an embodiment of the invention.

FIG. 1 is a diagram of an antenna structure 100 according to an embodiment of the invention. The antenna structure 100 may be applied in a mobile device, such as a smart phone, a tablet computer, or a notebook computer. In the embodiment of FIG. 1, the antenna structure 100 at least includes a ground element 110, a feeding radiation element 120, a first radiation element 130, and a second radiation element 140. The ground element 110, the feeding radiation element 120, the first radiation element 130, and the second radiation element 140 may be all made of metal materials, such as copper, silver, aluminum, iron, or their alloys. In some embodiments, the antenna structure 100 further includes a dielectric substrate 105, such as an FR4 (Flame Retardant 4) substrate, a PCB (Printed Circuit Board), or an FCB (Flexible Circuit Board). The ground element 110, the feeding radiation element 120, the first radiation element 130, and the second radiation element 140 may be all disposed on the same surface of the dielectric substrate 105, and therefore the antenna structure 100 is classified as a planar antenna.

The ground element 110 may be a ground copper foil, which may be coupled to a ground voltage. For example, the ground voltage may be provided by a system ground plane of a mobile device. In some embodiments, the ground element 110 extends from the system ground plane onto the dielectric substrate 105. The ground element 110 has a portion disposed on the dielectric substrate 105, and such a portion may substantially have a straight-line shape.

The feeding radiation element 120 may substantially have a straight-line shape, and it may be substantially perpendicular to the ground element 110. The feeding radiation element 120 has a first end 121 and a second end 122. The first end 121 of the feeding radiation element 120 is coupled to a signal source 190. For example, the signal source 190 may be an RF (Radio Frequency) module for exciting the antenna structure 100. The second end 122 of the feeding radiation element 120 extends away from the ground element 110.

The first radiation element 130 may substantially have an L-shape. The first radiation element 130 has a first end 131 and a second end 132. The first end 131 of the first radiation element 130 is coupled to the ground element 110. The second end 132 of the first radiation element 130 is adjacent to the second end 122 of the feeding radiation element 120. It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0). For example, a coupling gap GC1 may be formed between the second end 132 of the first radiation element 130 and the second end 122 of the feeding radiation element 120; alternatively, the second end 132 of the first radiation element 130 may be directed coupled to the second end 122 of the feeding radiation element 120. In some embodiments, the first radiation element 130 has a width-varying structure, so as to fine-tune the low-frequency impedance matching of the antenna structure 100. For example, the width W1 of the first end 131 of the first radiation element 130 may be greater than the width W2 of a central portion of the first radiation element 130, and the width W2 of the central portion of the first radiation element 130 may be greater than the width W3 of the second end 132 of the first radiation element 130. In alternative embodiments, adjustments are made such that the first radiation element 130 has an equal-width structure according to different design requirements.

The second radiation element 140 may substantially have an L-shape. The second radiation element 140 has a first end 141 and a second end 142. The first end 141 of the second radiation element 140 is coupled to the ground element 110. The second end 142 of the second radiation element 140 is coupled to the second end 122 of the feeding radiation element 120. Thus, the feeding radiation element 120 is coupled through the second radiation element 140 to the ground element 110. The feeding radiation element 120 is positioned between the first radiation element 130 and the second radiation element 140. That is, the second radiation element 140 and the first radiation element 130 are positioned at a left side and a right side of the feeding radiation element 120, respectively. In some embodiments, the width W4 of the feeding radiation element 120 is greater than the width W5 of the second radiation element 140, so as to fine-tune the high-frequency impedance matching of the antenna structure 100 and reduce the difficulty of manufacturing the antenna structure 100 (if the width W4 of the feeding radiation element 120 becomes larger, it may be easier to couple the signal source 190 to the feeding radiation element 120).

A first loop structure 150 is formed by the feeding radiation element 120, the first radiation element 130, and an edge 111 of the ground element 110. A first hollow region 155 is inside the first loop structure 150. For example, the first hollow region 155 may substantially have a rectangular shape. In addition, a second loop structure 160 is formed by the feeding radiation element 120, the second radiation element 140, and another edge 112 of the ground element 110. A second hollow region 165 is inside the second loop structure 160. For example, the second hollow region 165 may substantially have a rectangular shape or a square shape. The length of the first loop structure 150 may be greater than the length of the second loop structure 160. The width WL1 of the first hollow region 155 (i.e., the total length of the first hollow region 155 which is parallel to the X-axis) may be greater than the width WL2 of the second hollow region 165 (i.e., the total length of the second hollow region 165 which is parallel to the X-axis). It should be noted that the second loop structure 160 is a simple loop, and the second loop structure 160 includes neither any branching portion nor any protruding portion, thereby minimizing the total size of the antenna structure 100.

In some embodiments, the operation principles of the antenna structure 100 are as follows. The first loop structure 150 is excited to generate a first frequency band. The second loop structure 160 is excited to generate a second frequency band which is higher than the first frequency band. For example, the first frequency band may be from 2400 MHz to 2500 MHz, and the second frequency band may be form 5150 MHz to 5850 MHz. Accordingly, the antenna structure 100 can support at least the wideband operations of Bluetooth and WLAN (Wireless Local Area Networks) 2.4 GHz/5 GHz. According to practical measurements, a coupling effect may be induced between the first loop structure 150 and the second loop structure 160, such that the second frequency band corresponding to the second loop structure 160 may become lower. In other words, even if the second loop structure 160 includes neither any branching portion nor any protruding portion, the antenna structure 100 can still completely cover the high-frequency and low-frequency operations.

In some embodiments, the element sizes of the antenna structure 100 are as follows. The length of the first radiation element 130 (i.e., the length from the first end 131 to the second end 132) may be greater than the length of the second radiation element 140 (i.e., the length from the first end 141 to the second end 142). The length of the first loop structure 150 may be substantially equal to 0.5 wavelength ($\lambda/2$) of the first frequency band. The length of the second loop structure 160 may be substantially equal to 0.5 wavelength ($\lambda/2$) of the second frequency band. The first radiation element 130 has a first height H1 on the ground element 110 (i.e., the longest distance between the first radiation element 130 and the ground element 110 which is parallel to the Y-axis). The second radiation element 140 has a second height H2 on the ground element 110 (i.e., the longest distance between the second radiation element 140 and the ground element 110 which is parallel to the Y-axis). The first height H1 may be greater than the second height H2. The ratio of the width WL1 of the first hollow region 155 to the width WL2 of the second hollow region 165 may be about 2 (i.e., WL1/WL2=2). The first radiation element 130 has a side 136, which faces the ground element 110 and is substantially parallel to the ground element 110. The distance D1 between the edge 111 of the ground element 110 and the side 136 of the first radiation element 130 may be from 1 mm to 3 mm. The width of the coupling gap GC1 may be from about 0.2 mm to about 0.5 mm. The above ranges of element sizes are calculated and obtained according to many experiment results, and they can help to optimize the operation bandwidth and the impedance matching of the antenna structure 100.

Figure 2:
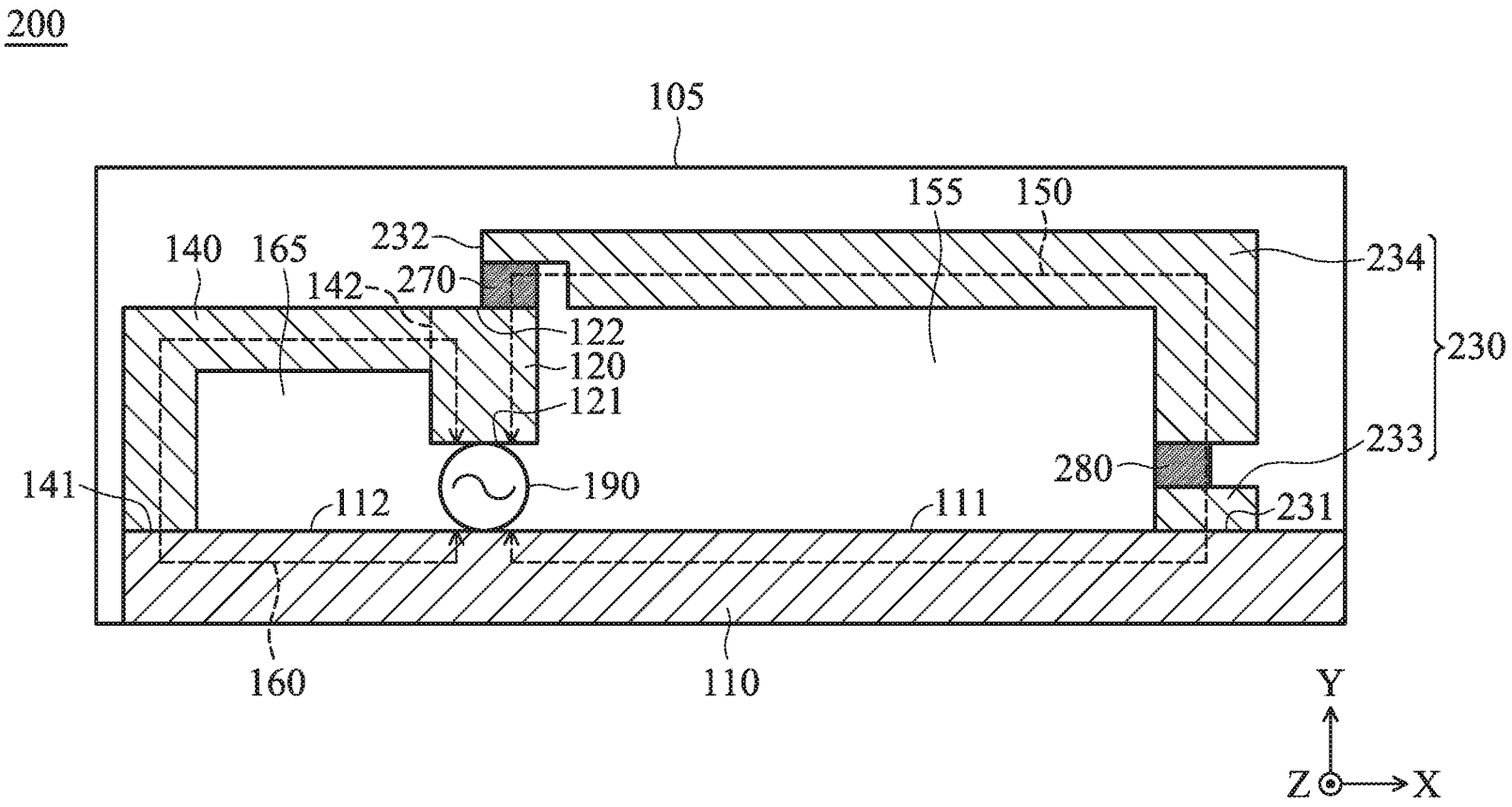
FIG. 2 is a diagram of an antenna structure according to an embodiment of the invention.

FIG. 2 is a diagram of an antenna structure 200 according to an embodiment of the invention. FIG. 2 is similar to FIG. 1. In the embodiment of FIG. 2, the antenna structure 200 further includes a first reactance element 270 and/or a second reactance element 280. Specifically, a first radiation element 230 of the antenna structure 200 has a first end 231 and a second end 232 (the first end 231 is coupled to the ground element 110), and includes a first portion 233 and a second portion 234. The first portion 233 is adjacent to the first end 231, and the second portion 234 is adjacent to the second end 232. The first reactance element 270 is coupled between the second end 122 of the feeding radiation element 120 and the second end 232 of the first radiation element 230. The second reactance element 280 is embedded in the first radiation element 230. The second reactance element 280 is coupled in series between the first portion 233 and the second portion 234 of the first radiation element 230. In some embodiments, each of the first reactance element 270 and the second reactance element 280 is implemented with a respective tunable circuit element. According to practical measurements, the incorporation of the first reactance element 270 and the second reactance element 280 helps to increase the operation bandwidth of the antenna structure 200 and minimize the total size of the antenna structure 200. Other features of the antenna structure 200 of FIG. 2 are similar to those of the antenna structure 100 of FIG. 1. Therefore, the two embodiments can achieve similar levels of performance.

Figure 3:
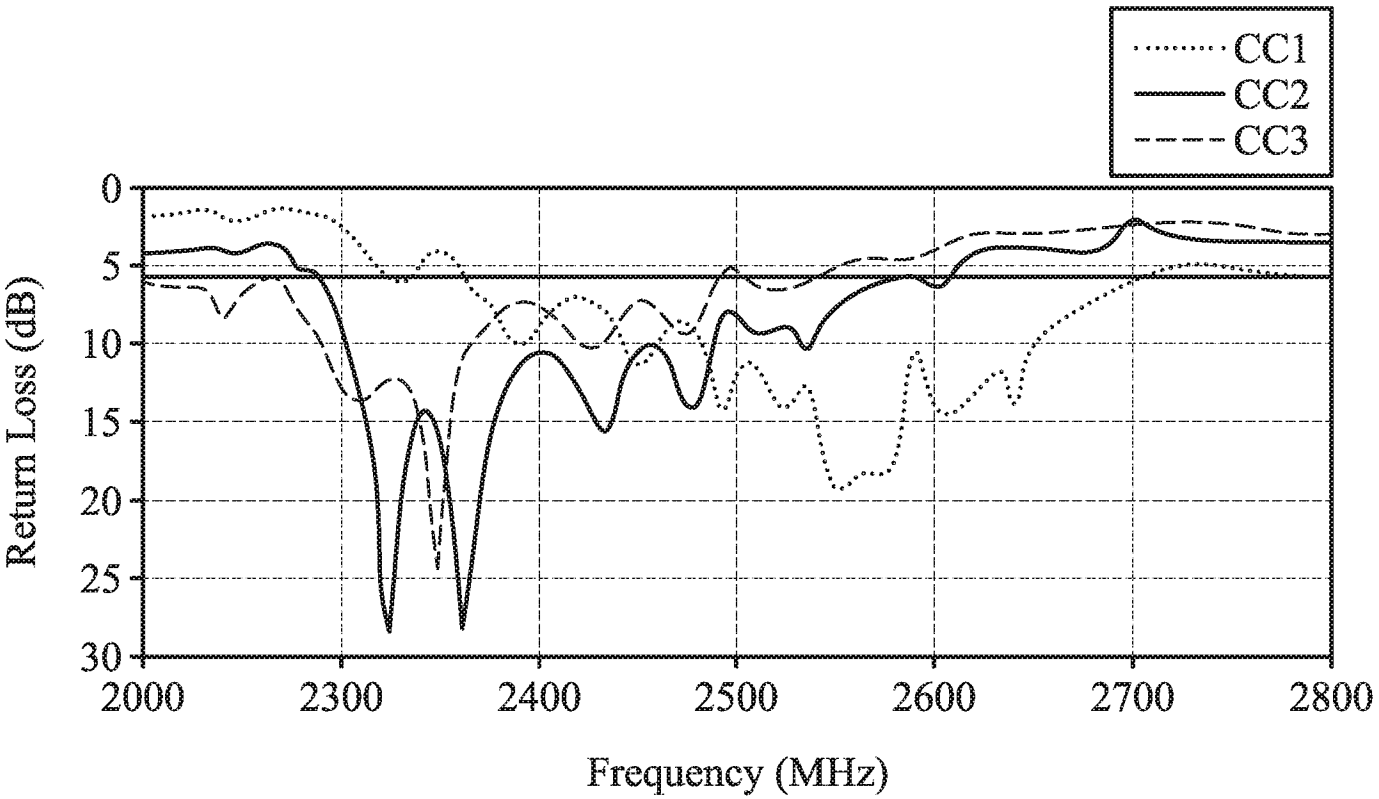
FIG. 3 is a diagram of return loss of an antenna structure according to an embodiment of the invention.

FIG. 3 is a diagram of return loss of the antenna structure 200 according to an embodiment of the invention. In the embodiment of FIG. 3, the first reactance element 270 is a capacitor, whose capacitance may be from about 0 pF to about 5 pF. The first reactance element 270 may be a fixed capacitor or a variable capacitor. As shown in FIG. 3, a first curve CC1 represents the operation characteristics of the antenna structure 200 when the capacitance of the first reactance element 270 is 0.1 pF, a second curve CC2 represents the operation characteristics of the antenna structure 200 when the capacitance of the first reactance element 270 is 0.3 pF, and a third curve CC3 represents the operation characteristics of the antenna structure 200 when the capacitance of the first reactance element 270 is 0.5 pF. According to the measurement of FIG. 3, if the capacitance of the first reactance element 270 becomes larger, the second frequency band of the antenna structure 200 may become lower, and conversely, if the capacitance of the first reactance element 270 becomes smaller, the second frequency band of the antenna structure 200 may become higher.

Figure 4:
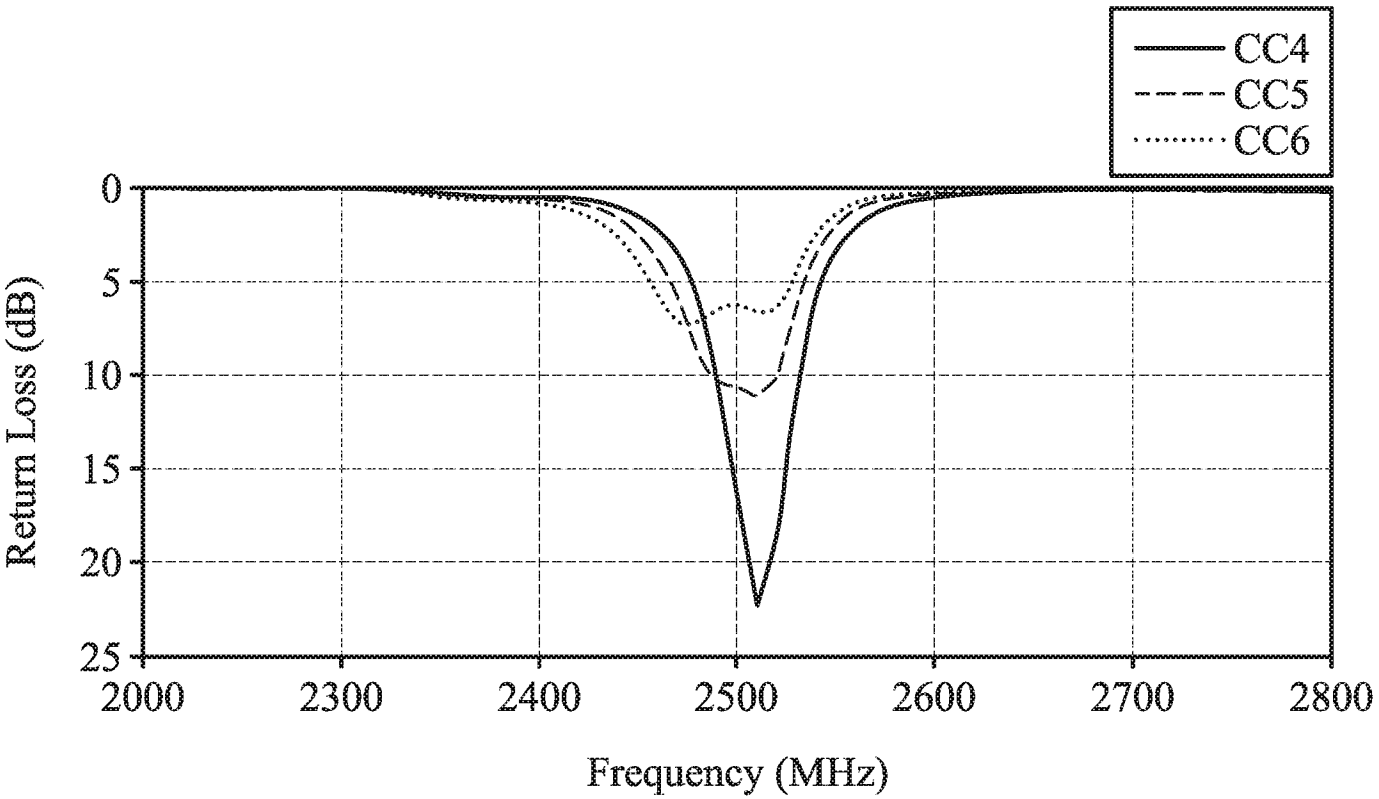
FIG. 4 is a diagram of return loss of an antenna structure according to an embodiment of the invention.

FIG. 4 is a diagram of return loss of the antenna structure 200 according to an embodiment of the invention. In the embodiment of FIG. 4, the second reactance element 280 is an inductor, whose inductance may be from about 0 nH to about 5 nH. The second reactance element 280 may be a fixed inductor or a variable inductor. As shown in FIG. 4, a second curve CC4 represents the operation characteristics of the antenna structure 200 when the inductance of the second reactance element 280 is 3.8 nH, a fifth curve CC5 represents the operation characteristics of the antenna structure 200 when the inductance of the second reactance element 280 is 4 nH, and a sixth curve CC6 represents the operation characteristics of the antenna structure 200 when the inductance of the second reactance element 280 is 4.2 nH. According to the measurement of FIG. 4, if the inductance of the second reactance element 280 becomes larger, the first frequency band of the antenna structure 200 may become lower, and conversely, if the inductance of the second reactance element 280 becomes smaller, the first frequency band of the antenna structure 200 may become higher.

Figure 5:
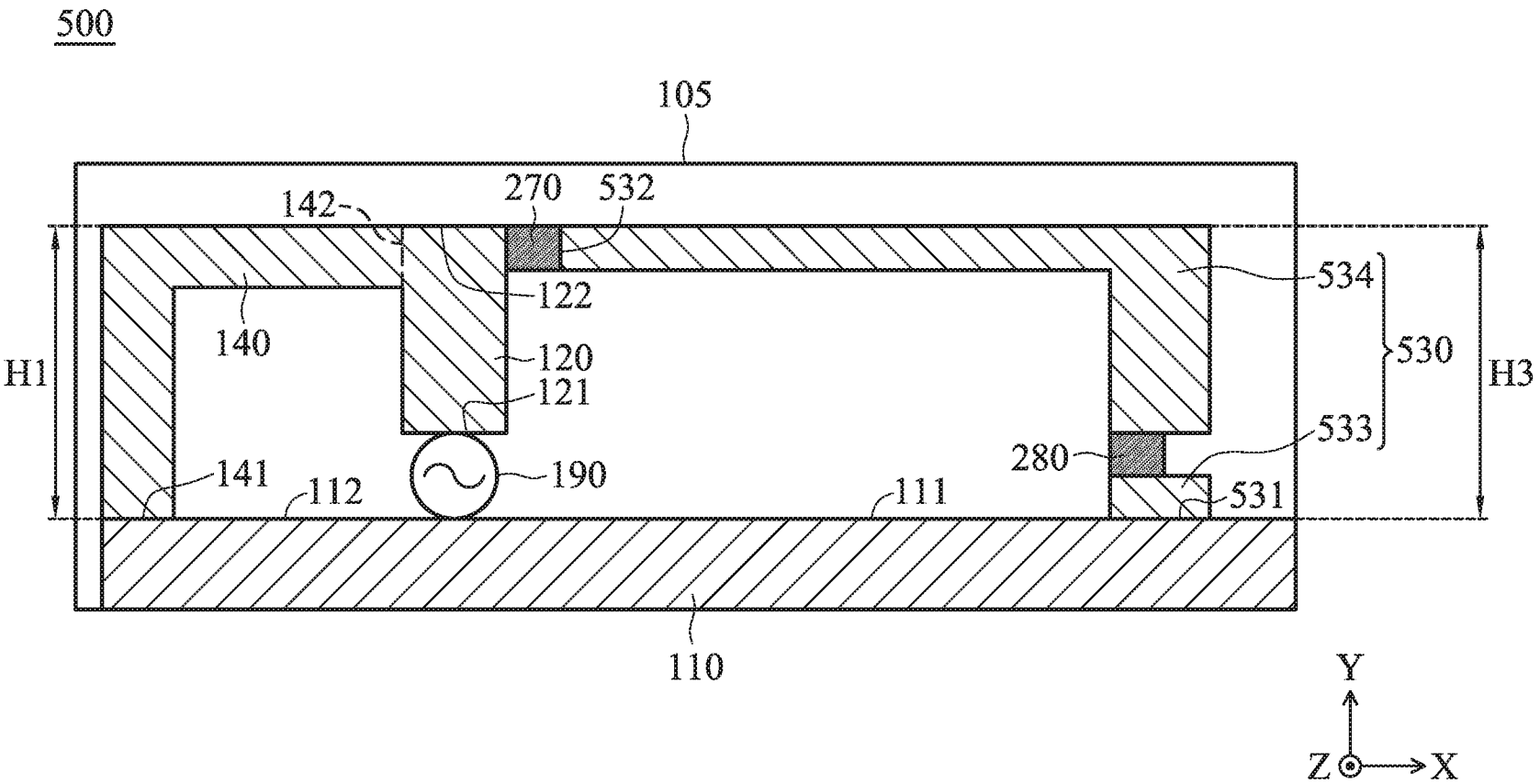
FIG. 5 is a diagram of an antenna structure according to another embodiment of the invention.

FIG. 5 is a diagram of an antenna structure 500 according to another embodiment of the invention. FIG. 5 is similar to FIG. 2. In the embodiment of FIG. 5, a first radiation element 530 of the antenna structure 500 has a first height H3 on the ground element 110 (i.e., the longest distance between the first radiation element 530 and the ground element 110 which is parallel to the Y-axis). The second radiation element 140 has a second height H2 on the ground element 110 (i.e., the longest distance between the second radiation element 140 and the ground element 110 which is parallel to the Y-axis). The first height H3 may be substantially equal to the second height H2. With such a design, the total height of the antenna structure 500 (or the total length of the antenna structure 500 which is parallel to the Y-axis) is reduced further. Other features of the antenna structure 500 of FIG. 5 are similar to those of the antenna structure 200 of FIG. 2. Therefore, the two embodiments can achieve similar levels of performance.

Figure 6:
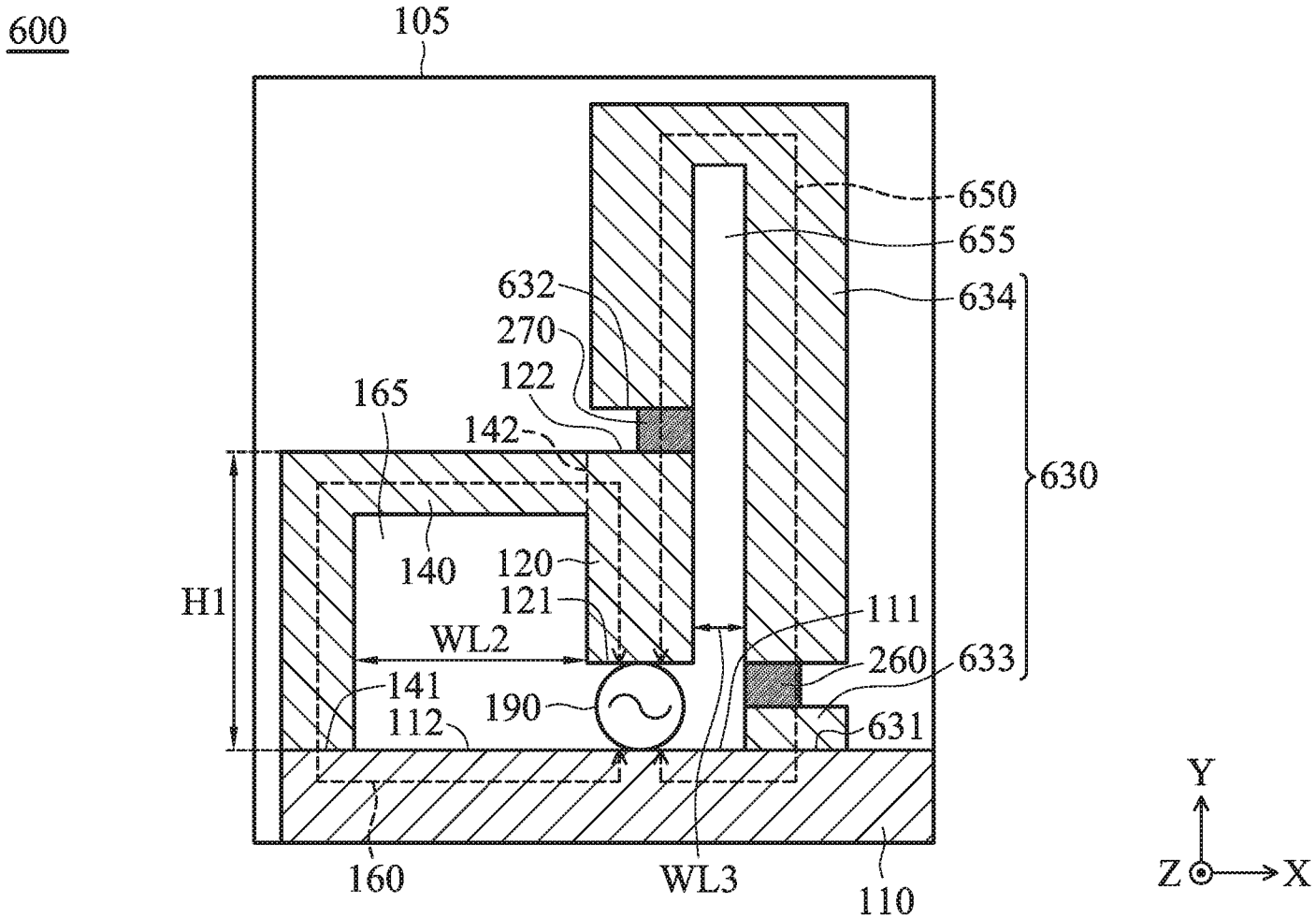
FIG. 6 is a diagram of an antenna structure according to another embodiment of the invention.

FIG. 6 is a diagram of an antenna structure 600 according to another embodiment of the invention. FIG. 6 is similar to FIG. 2. In the embodiment of FIG. 6, a first loop structure 650 is formed by the feeding radiation element 120, a first radiation element 630, and the edge 111 of the ground element 110 of the antenna structure 600. A first hollow region 655 is inside the first loop structure 650. The first hollow region 655 may substantially have a rectangular shape. In addition, a second loop structure 160 is formed by the feeding radiation element 120, the second radiation element 140, and the edge 112 of the ground element 110. A second hollow region 165 is inside the second loop structure 160. The second hollow region 165 may substantially have a rectangular shape or a square shape. The width WL3 of the first hollow region 655 (i.e., the total length of the first hollow region 655 which is parallel to the X-axis) may be smaller than the width WL2 of the second hollow region 165 (i.e., the total length of the second hollow region 165 which is parallel to the X-axis). For example, the ratio of the width WL3 of the first hollow region 655 to the width WL2 of the second hollow region 165 may be about 0.5 (i.e., WL3/WL2=1/2). With such a design, the total width of the antenna structure 600 (or the total length of the antenna structure 600 which is parallel to the X-axis) is reduced further. Other features of the antenna structure 600 of FIG. 6 are similar to those of the antenna structure 200 of FIG. 2. Therefore, the two embodiments can achieve similar levels of performance.

The invention proposes a novel antenna structure including two loop structures. Since at least one of the aforementioned loop structures includes neither any branching portion nor any protruding portion, the total size of the proposed antenna structure is effectively minimized, and it does not affect the operation bandwidth of the antenna structure. In conclusion, the invention has at least the advantages of small size and wide bandwidth, and therefore it is suitable for application in a variety of compact mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-6. The invention may merely include any one or more features of any one or more embodiments of FIGS. 1-6. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground element;

a feeding radiation element, coupled to a signal source;

a first radiation element, coupled to the ground element, wherein the first radiation element is adjacent to the feeding radiation element;

a second radiation element, wherein the feeding radiation element is coupled through the second radiation element to the ground element; and a first reactance element, coupled between the feeding radiation element and one end of the first radiation element;

wherein a first loop structure is formed by the feeding radiation element, the first radiation element, and the ground element;

wherein a second loop structure is formed by the feeding radiation element, the second radiation element, and the ground element, and wherein the first loop structure and the second loop structure do not overlap each other.

2. The antenna structure as claimed in claim 1, wherein the feeding radiation element is positioned between the first radiation element and the second radiation element.

3. The antenna structure as claimed in claim 1, wherein the feeding radiation element substantially has a straight-line shape.

4. The antenna structure as claimed in claim 1, wherein the first radiation element substantially has an L-shape.

5. The antenna structure as claimed in claim 1, wherein the second radiation element substantially has an L-shape.

6. The antenna structure as claimed in claim 1, wherein the second loop structure includes neither any branching portion nor any protruding portion.

7. The antenna structure as claimed in claim 1, wherein the first reactance element is a capacitor.

8. The antenna structure as claimed in claim 7, wherein a capacitance of the capacitor is from 0 pF to 5 pF.

9. The antenna structure as claimed in claim 1, further comprising:

a second reactance element, embedded in the first radiation element.

10. The antenna structure as claimed in claim 9, wherein the second reactance element is an inductor.

11. The antenna structure as claimed in claim 10, wherein an inductance of the inductor is from 0 nH to 5 nH.

12. The antenna structure as claimed in claim 1, wherein the first loop structure is excited to generate a first frequency band, and the second loop structure is excited to generate a second frequency band which is higher than the first frequency band.

13. The antenna structure as claimed in claim 12, wherein the first frequency band is from 2400 MHz to 2500 MHz, and the second frequency band is from 5150 MHz to 5850 MHz.

14. The antenna structure as claimed in claim 12, wherein a length of the first loop structure is equal to 0.5 wavelength of the first frequency band, and a length of the second loop structure is equal to 0.5 wavelength of the second frequency band.

15. The antenna structure as claimed in claim 1, wherein the first radiation element has a first height on the ground element, the second radiation element has a second height on the ground element, and the first height is greater than the second height.

16. The antenna structure as claimed in claim 1, wherein the first radiation element has a first height on the ground element, the second radiation element has a second height on the ground element, and the first height is equal to the second height.

17. The antenna structure as claimed in claim 1, wherein a first hollow region is inside the first loop structure, a second hollow region is inside the second loop structure, and a width of the first hollow region is greater than a width of the second hollow region.

18. The antenna structure as claimed in claim 1, wherein a first hollow region is inside the first loop structure, a second hollow region is inside the second loop structure, and a width of the first hollow region is smaller than a width of the second hollow region.

19. An antenna structure, comprising:

a ground element;

a feeding radiation element, coupled to a signal source;

a first radiation element, coupled to the ground element, wherein the first radiation element is adjacent to the feeding radiation element; and a second radiation element, wherein the feeding radiation element is coupled through the second radiation element to the ground element;

wherein a first loop structure is formed by the feeding radiation element, the first radiation element, and the ground element;

wherein a second loop structure is formed by the feeding radiation element, the second radiation element, and the ground element, wherein the first loop structure and the second loop structure do not overlap each other, and wherein the second loop structure includes neither any branching portion nor any protruding portion;

wherein the feeding radiation element is positioned between the first radiation element and the second radiation element;

wherein a coupling gap is formed between one end of the first radiation element and the feeding radiation element;

wherein each of the first radiation element and the second radiation element substantially has an L-shape.

* * * * *